US008201391B2

(12) United States Patent
Peck et al.

(10) Patent No.: US 8,201,391 B2
(45) Date of Patent: Jun. 19, 2012

(54) METHOD FOR OPERATION OF AN INTERNAL COMBUSTION ENGINE AND DEVICE FOR CARRYING OUT THE METHOD

(75) Inventors: Rainer Peck, Ludwigsburg (DE); Matthias Gaenswein, Esslingen (DE); Thomas Breitbach, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 659 days.

(21) Appl. No.: 12/090,469

(22) PCT Filed: Sep. 22, 2006

(86) PCT No.: PCT/EP2006/066652

§ 371 (c)(1),
(2), (4) Date: Jun. 18, 2008

(87) PCT Pub. No.: WO2007/045542

PCT Pub. Date: Apr. 26, 2007

(65) Prior Publication Data

US 2008/0245059 A1 Oct. 9, 2008

(30) Foreign Application Priority Data

Oct. 18, 2005 (DE) ..... 10 2005 049 770

(51) Int. Cl.
*F01N 3/18* (2006.01)

(52) U.S. Cl. ..... 60/285; 60/286; 60/295

(58) Field of Classification Search ..... 60/285, 60/286, 295, 297
See application file for complete search history.

(56) References Cited

U.S. PATENT DOCUMENTS

| | | | | |
|---|---|---|---|---|
| 5,765,532 | A * | 6/1998 | Loye | 123/435 |
| 6,729,297 | B2 * | 5/2004 | Futonagane et al. | 123/299 |
| 7,047,729 | B2 | 5/2006 | Van Nieuwstadt et al. | |
| 2002/0157386 | A1 * | 10/2002 | Hiranuma et al. | 60/295 |
| 2005/0076635 | A1 * | 4/2005 | Suyama et al. | 60/276 |
| 2005/0086929 | A1 | 4/2005 | Nieuwstadt et al. | |
| 2007/0169466 | A1 * | 7/2007 | Yokoi et al. | 60/277 |

FOREIGN PATENT DOCUMENTS

| | | | |
|---|---|---|---|
| DE | 199 06 287 | A1 | 8/2000 |
| DE | 101 08 720 | A1 | 9/2002 |
| DE | 103 33 441 | A1 | 2/2004 |
| EP | 1 154 130 | A1 | 11/2001 |
| EP | 1505271 | | 2/2005 |
| EP | 1617062 | A1 * | 1/2006 |
| JP | 2000-161105 | | 6/2000 |
| JP | 2002-161733 | | 6/2002 |
| JP | 2005-54723 | | 3/2005 |
| WO | WO 2004094800 | A1 * | 11/2004 |
| WO | WO 2007/045542 | | 4/2007 |

* cited by examiner

*Primary Examiner* — Thomas Denion
*Assistant Examiner* — Jonathan Matthias
(74) *Attorney, Agent, or Firm* — Merchant & Gould P.C

(57) ABSTRACT

A method for operation of an internal combustion engine, comprising an exhaust treatment device in the exhaust system thereof, with application of a reagent under given operating conditions of the internal combustion engine and/or the exhaust treatment device and a device for carrying out the method are disclosed, wherein a correction parameter is determined for a reagent signal, describing the amount of reagent to be introduced into the exhaust system and the correction parameter is determined by means of a comparison of a measure of the actual amount of the reagent in the exhaust system, which should be introduced based on a measure of a pre-determined set amount and the measure of the set amount. The above method permits a particularly exact maintenance of the amount of reagent introduced into the exhaust system in accordance with the pre-determined measure for the set amount.

13 Claims, 1 Drawing Sheet

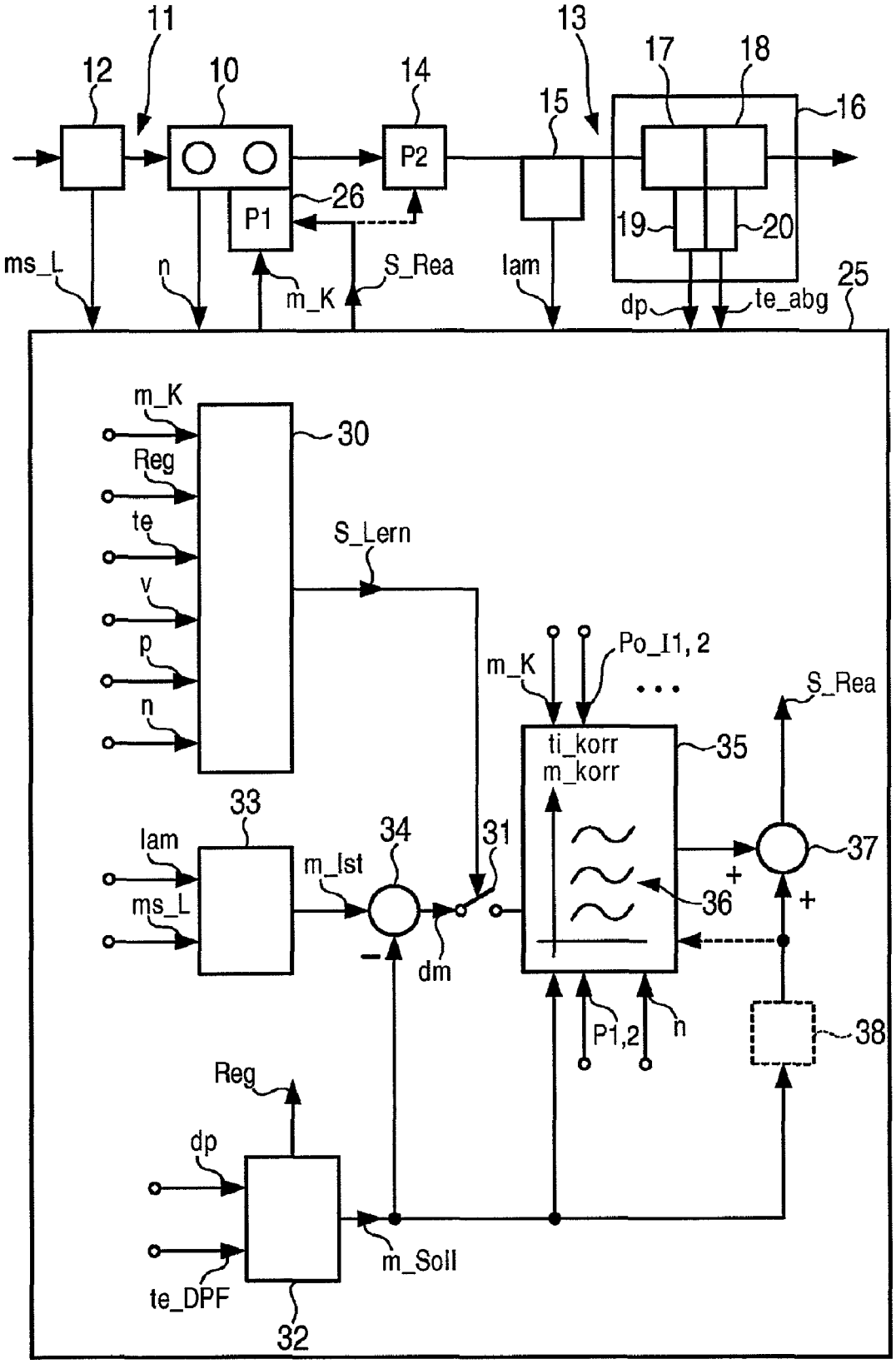
11
12
10
14
13
15
17
18
16
P2
P1
26
19
20
ms_L
n
m_K
S_Rea
lam
dp
te_abg
25
m_K
Reg
te
v
p
n
30
S_Lern
m_K
Po_I1, 2
S_Rea
ti_korr
m_korr
35
33
34
31
37
lam
ms_L
m_Ist
36
dm
P1,2
n
38
Reg
dp
te_DPF
m_Soll
32

METHOD FOR OPERATION OF AN INTERNAL COMBUSTION ENGINE AND DEVICE FOR CARRYING OUT THE METHOD

TECHNICAL FIELD

The invention is based on the method for the operation of an internal combustion engine, whose exhaust zone, which contains an exhaust gas treating device, is admitted with a reagent at default operating statuses' of the internal combustion engine and/or of the exhaust gas treating device, and on the device for carrying out this method according to the category of independent claims.

BACKGROUND

Due to DE 199 06 287 A1 a procedure for controlling a combustion engine became known, which has an exhaust gas treating device arranged in its exhaust zone, that contains a particle filter, which retains particles contained in the exhaust gas. For a proper operation of the particle filter a particle loading status has to be known, which can be determined indirectly by the differential pressure present in the particle filter or by model calculations. The regeneration of the particle filter takes place by burning off the particles stored in the particle filter, which happens in the temperature ranges of e.g. 932° F.-1202° F. It is particularly provided that additional fuel is brought into the exhaust zone of the combustion engine, which reacts exothermically as a combustible with the oxygen in the exhaust zone. The fuel is oxidized for example on the catalytically effective surface of a catalyst. On the one hand this increases the temperature of the catalyst, and on the other hand the temperature of the off-gas stream behind the catalyst, which is then admitted to the following particle filter. The catalyst can also be already contained in the particle filter. The fuel arrives for example by at least one fuel injection in the exhaust zone of the combustion engine.

Due to DE 101 08 720 A1 a procedure and a device for operating a particle filter, that is arranged in the exhaust zone of a combustion engine became known, which are based on at least one operating parameter, which provides the condition of the combustion engine and/or the condition of the particle filter, and moreover stipulates a parameter, which describes the intensity of the particle burn. The parameter is compared to a threshold. In the case of an exceeding of the threshold arrangements for declining are initiated, which aim on the encroachments to reduce the oxygen content in the exhaust gas.

Due to DE 103 33 441 A1 a procedure for operating a particle filter, that is arranged in the exhaust zone of a combustion engine became known, which uses a lambda signal, provided by a lambda sensor, as a dimension of the burning off—speed of the particles during the regeneration of the particle filter. The determined dimension is used to control the particle burning off temperature with the objective of preventing an overheating of the particle filter. A nominal value for the lambda signal or for a change of the lambda signal is given. In case of a noticed deviation between the nominal and the actual value, an intervention takes place for example into the position of the throttle valve, into the charge pressure of an exhaust gas turbocharger or into the determination of a exhaust gas recirculation rate. According to one configuration an actuating element is provided, arranged in the exhaust gas conduit, which brings fuel or another oxidant to the off-gas stream.

The invention is based on a procedure for operating a combustion engine, whose exhaust zone, that contains an exhaust gas treating device, is admitted with a reagent at preset operating statuses of the combustion engine and/or of the exhaust gas treating device, and a device for implementing this procedure, which allows the provision of a sufficient amount of the reagent on the one hand, and prevents the damage of the exhaust gas treating device by an overdose on the other hand.

This task is solved for the given situation by the specified characteristics of the independent claims.

SUMMARY

According to the invention for operating a combustion engine, whose exhaust zone, that contains an exhaust gas treating device, is admitted with a reagent at preset operating statuses of the combustion engine and/or of the exhaust gas treating device, an ascertainment of a correction value for the reagent signal is provided, which determines the amount of reagent that has to be put into the exhaust zone. The correction value is ascertained by a comparison of a dimension of the actual value of the reagent in the exhaust zone, which has been introduced according to a dimension for a preset nominal value, and a dimension of the nominal value.

According to the invention it is possible to adapt the reagent signal, which determines the amount of reagent that has to be brought into the exhaust zone. The preset dimension for the nominal value is corrected by the correction value. The invention considers tolerances and ageing phenomena of a reagent introduction device as well as stream proportions, for example blast waves of the reagent in the reagent introduction device and/or in fuel metering device of the combustion engine, and they can be compensated. The adaptation is based on a comparison of a dimension for the actual value of the reagent in the exhaust zone, which has been introduced according to a dimension for a preset nominal value, and a dimension of the nominal value.

The invention prevents an under dose, which would lead to an insufficient exhaust gas treatment, and an overdose, which would lower efficiency and lead to a breakthrough of the reagent. Particularly, an inadmissible burden of the components in the exhaust gas treating device by a possibly occurring over-temperature, due to a too high reagent dose, is prevented.

The correction value can be a dimension for the reagent amount or a parameter like for example a time duration for the reagent introduction.

Advantageous improvements and configurations of the invention arise from dependent claims.

One configuration provides that the dimension for the actual value is determined from a measured lambda signal in the exhaust zone. With this method a sensor signal, that has been supplied by a lambda sensor, for a lambda regulation in the exhaust zone, anyway, can be additionally used for determining the dimension for the actual value. Another possibility provides a calculation of the air lambda occurring in the exhaust zone.

Especially advantageous is a combination with a second, already known, soft-ware function, which determines the air lambda of each operation point in a normal driving operation, and which then provides this information as a reference for the present suggested function. If this function also considers the gas duration at least in the exhaust zone of the combustion engine and/or in the combustion engine itself and/or in the exhaust zone, then the present suggested method can be used in a dynamic operation of the combustion engine as well.

An exact dimension of the actual value is determined if additionally to the lambda an air signal is used, which is acquired in the exhaust zone of the combustion engine.

One configuration provides that the correction value is determined in a periodic learning procedure, which is carried out in default operating statuses of the combustion engine and/or the exhaust gas treating device.

The correction value can be determined for example in an operating status of the combustion engine, whose fuel amount, which has been injected into the combustion engine, or a variation of the fuel amount lies within a marginal value. With this procedure it can be checked whether there is at least approximately a stationary operation of the combustion engine.

The correction value can furthermore be determined for example by varying fuel amounts, that have been injection to the combustion engine, in order to cover a wide range of different operating statuses of the combustion engine. Particularly, it can be provided that the correction value is determined in an operating status of the combustion engine, which corresponds with the engine idle.

Furthermore it can be provided that the correction value is determined by a reagent, which is under pressure, at varying pressures of the reagent.

One configuration provides, that the correction value is added to the dimension for the actual value of the reagent or that the nominal value is corrected multiplicatively.

According to a configuration it is provided that the reagent is fuel, which is injected at least in one fuel post-injection of the combustion engine. In this case the correction value is determined separately for each fuel post-injection as well as for multiple fuel post-injections. Thereby appearing time-varying conditions at the introduction of the reagent can be considered, particularly by blast waves in the reagent introduction device and/or in the fuel metering device of the combustion engine.

According to one configuration it is provided that the reagent is brought directly into the exhaust zone. I this case fuel can be for example the reagent as well.

The invention for operating a combustion engine is based at first on a controller, which is customized for the implementation of the procedure. The controller preferably contains at least one electric storage, which stores the steps of the procedure as a computer program. The controller contains preferably a special storage, which stores the different values of the correction value.

Further advantageous improvements and configurations of the invention arise from further dependent claims and from the following description.

BRIEF DESCRIPTION OF THE DRAWING

The FIGURE shows function blocks, which are suitable for the implementation of the invention's procedure for operating a combustion engine.

DETAILED DESCRIPTION

FIG. 1 shows a combustion engine 10, which has an air detection 12 in its suction zone 11, a reagent introduction device 14 in its exhaust zone, a lambda sensor 15 and an exhaust gas treating device 16. The exhaust gas treating device 16 contains at least on catalyst 17 and/or a particle filter 18. The exhaust gas treating device 16 is supplied with a pressure sensor 18 and a temperature sensor 20.

The air detection 12 delivers an air signal ms_L, the combustion engine 10 an engine speed n, the lambda sensor a lambda signal lam, the pressure sensor 19 an exhaust gas pressure signal dp and the temperature sensor 20 an exhaust gas temperature signal te_abg to a controller 25.

The controller 25 provides a fuel signal m_K for a fuel metering 26, in which the first pressure p1 occurs, and a reagent signal S_Rea for the fuel metering 26 as well as for the reagent introduction device 14, in which a second pressure p2 occurs.

The controller 25 contains an operating status determination 30, which is supplied with the fuel signal m_K, the speed engine signal n, a regeneration signal Reg, a temperature signal te, a speed signal v as well as a pressure signal p. The operating status determination 30 delivers a learn-enabling signal S_Lern to a switch 31.

A reagent controlling 32 is provided, which is supplied with the exhaust gas pressure signal dp as well as the exhaust gas temperature te_abg, and which provides the regeneration signal Reg as well as a dimension m_Soll for the nominal value of a reagent.

Out of the lambda signal lam and die air signal ms_L an actual value determination 33 determines a dimension m_Ist for the actual value of the reagent that is in the exhaust zone 13.

A comparator 34 compares the dimension m_Soll for the nominal value with the dimension m_Ist for the actual value of the reagent and provides a deviation, which is delivered to a correction value storage 35 by the switch 31.

The correction value storage 35 contains an engine map 36, which encloses different values of a correction value ti_Korr. The correction value storage 35 is supplied with the deviation dm, the dimension m_Soll for the nominal value, the fuel signal m_K, the first and second pressure p1, p2, information about at least on fuel post-injection Po_I1, Po_I2 as well as the engine speed n. The correction value storage 35 delivers the correction value ti_Korr, m_Korr to an adder 37, which adds the correction value ti_Korr, m_Korr to the dimension m_Soll for the nominal value and provides as the result the reagent signal S_Rea.

An alternative is listed dash-lined, which converses the dimension m_Soll for the nominal value by a transformation into one value, which illustrates the dimension m_Soll for example in time-units.

According to the invention it is proceeded as follows:

The exhaust gas, which has been ejected by the combustion engine 10, is cleaned from at least exhaust gas component by the exhaust gas treating device 16, which is arranged in the exhaust zone 13. The exhaust gas treating device 16 contains for example at least one catalyst 17, for instance an oxidation-catalyst and/or a three-way-catalyst and/or a NOx-storage catalyst and/or a SCR-catalyst and/or a particle filter 18. The catalyst 17 can a part of the particle filer 18.

The invention is based on the introduction of a reagent in the exhaust zone 13. An oxidizable reagent like e.g. fuel can be provided for the heating of a component like e.g. the exhaust gas treating device 16 or for heating of the exhaust gas in the exhaust zone. An oxidizable reagent can react exothermically with the present oxygen in the exhaust zone 13. The exothermic reaction will possibly take place in the catalyst 17, whereby a heating of the catalyst 17 occurs in addition to a heating of the exhaust.

The reagent can furthermore be provided for example for the transformation of exhaust gas components into less harmful components. A SCR-catalyst fro instance requires a reagent for transforming NOx. Ammoniac is for example provided as a reagent, which can be attained from an urea-hydrogen-solution introduced to the exhaust zone 13 or directly introduced into the exhaust zone 13. Alternatively the reagent can be provided interior power-operated.

The reagent can be furthermore provided for the regeneration of e.g. NOx-storage catalysts.

The displayed implementation model shows the reagent introduction device 14, which introduces the reagent directly in the exhaust zone 13. The reagent introduction device 14 is for instance realized as an injection valve, which injects the reagent, that shows the second pressure p2, into the exhaust zone 13.

Alternatively or additionally it can be provided that the reagent is injected interior power-operated into the combustion engine 10. Therefore the fuel metering device 26 can be used, which injects the fuel, which shows the first pressure p1, into the cylinder of the combustion engine 10. The introduction of the reagent can be carried out for example with at least one fuel post-injection Po_I1, Po_I2.

Firstly a fuel post-injection Po_I2 can be scheduled, which burns in the combustion engine 10, but only contributes partially to the production of torque. With this step a heating of the exhaust gas can be achieved in particular. Additionally or alternatively at least one fuel post-injection Po_I1 can be scheduled, whereby fuel arrives unburnt in the exhaust zone 13, where it can either react exothermically and/or can be used for chemical conversion processes.

The amount of the reagent, that has to be introduced by the fuel metering device 26 and/or the reagent introduction device 14, is determined by the reagent signal S_Rea, which for example determines an injection duration and where necessary an injection moment of a valve.

The displayed implementation model is based on the use of the reagent for heating the particle filter 18. The heating can be necessary to heat the particle filter 18 to a temperature of e.g. 932° F.-1202° F. in order to induce the regeneration process of the particle filter 18, which burns the stored particles independently. The heating can for instance take place indirectly per the exhaust gas temperature. Furthermore it can be provided that the reagent reacts exothermically in the catalyst 17, which is preferably arranged within the particle filter 18. Thereby the particle filter 18 is heated indirectly as well as directly.

The regeneration controller 32 can detect the requirement of a regeneration of the particle filter 18 by e.g. the occurring pressure difference in the particle filter 18. For this purpose the pressure sensor 19 acquires the exhaust gas pressure dp, which occurs in total at the particle filter 18 or at the exhaust gas treating device 16. The regeneration controller 32 considers furthermore preferably the exhaust gas temperature te_abg which is at least one dimension for the temperature of the particle filter 18.

One significant function of the regeneration controller 32 is to provide at least the dimension m_Soll for the nominal value of the reagent. The dimension m_Soll for the nominal value has to be determines comparatively accurate. A too low nominal value causes that the required starting temperature for the regeneration of the particle filter cannot be achieved. As long as the reagent is used as a reagent for chemical conversions, the desired transformation would not, or only in an insufficient way, take place, if the dimension m_Soll for the nominal value is too low. A too high nominal value would jeopardize the exhaust gas treating device 18 in respect of an excessive temperature. At this it has to be considered that the starting regeneration of the particle filter 18, which burns the stored particles, is an exothermic reaction as well, that leads to a significant impact on the temperature.

On the basis of experiments it was established that the dimension m_Soll for the nominal value of the reagent can deviate from the actual value m_Ist of the reagent in the exhaust zone 13. Tolerances in the mechanic components, for example the fuel metering device 26 and/or the reagent introduction device 14, are responsible for this. Streaming conditions in the reagent introduction device 14 and/or fuel metering device 26 have a significant impact as well. The introduction processes can in particular cause blast waves, which lead to the actual injection of more or less reagent or rather fuel than the dimension m_Soll for the nominal value.

According to the invention a provision of the correction value ti_Korr, m_Korr is designated, which is provided for the reagent signal S_Rea, which determines the amount of reagent that has to be introduced into the exhaust zone 13. The correction value ti_Korr, m_Korr is acquired by a comparison in the comparator 34 of the dimension m_Ist for the actual value of the reagent in the exhaust zone 13 and the dimension m_Soll for the nominal value.

The correction value ti_Korr, m_Korr is preferably provided in individual FIGURES, which are deposited in the engine map 36 of the correction value storage 35.

The actual value m_Ist of the reagent in the exhaust zone 13 is acquired preferably by the lambda signal lam, which is provided by the lambda sensor 15, that is arranged in the exhaust zone 13. The lambda sensor 15 can be arranged upstream before the exhaust gas treating device 16, after the exhaust gas treating device 16 or in a specified position in the exhaust gas treating device 16, which then contains more components than in e.g. the catalyst 17 and the particle filter 18.

Preferably it is a broad band lambda sensor, which can measure a lambda, that can be in a range of e.g. 0.6-4.0. On the basis of experiments it could be established that the lambda sensor 15 can, despite a possible present high oxygen percentage and a simultaneously present fuel percentage and for example the presence of hydrogen, still provide a correct or at least a reproducible lambda signal lam, from which the dimension m_Ist of the reagent in the exhaust zone 13 can be determined reliably and reproducibly. Preferably the air signal ms_L is considered during the determination.

The air lambda in the exhaust zone 13 can be calculated by known parameters of the combustion engine 10, like for example the air signal ms_L and the fuel signal, m_K instead of a measurement with the lambda sensor 15.

Notably advantageous is one configuration, according to which the air lambda, which can be expected during a normal operation, is provided for the suggested function as a reference by another, already known, function. Thereby the change of the air lambda due to the dosage of the reagent can be determined. A precondition is, that the reagent has an impact on the air lambda. This is the case for example, if the reagent is fuel, which is either introduced directly into the exhaust zone 13 or is provided interior power-operated by e.g. at least one fuel post-injection. Thereby an actual lambda is always provided, independent of the gas durations in the suction zone 11 of the combustion engine and/or in the combustion engine 10 itself and/or in the exhaust zone 13.

A change of lambda caused by the introduction of reagent can be acquired by the relation:

$$\text{delta } (1/\text{lambda})=(14.5\times m_Ist)/ms_L$$

whereby a multiplicative correction factor KF can be considered if necessary, which can be achieved by the development of a thermodynamic balance at the lambda sensor 15, that is not always complete. If an accuracy of measurement of the lambda sensor 15 of 4% regarding the oxygen concentration, a lambda of 2 and an exactness of the air detection 12 of e.g.

5% is assumed, the dimension m_Ist for the actual value of the reagent in the exhaust zone 13 can be acquired with an accuracy of approximately 6.5%.

The deviation dm, which has been established in the comparator 34, is used to determine the individual factors in the engine map 36. The determination preferably takes place for different fuel signals m_K and/or different pressures p1, p2 of the reagent and/or depending on at least one fuel post-injection P0_I1, Po_I2.

Practically different factors are deposited depending on whether the first or the second or further fuel post-injections Po_I1, Po_I2 are scheduled as separate or multiple fuel post-injections Po_I1, Po_I2 in one cycle. Generally the deviations dm do not match due to the blast waves that develop different during different configurations of fuel post-injections Po_I1, Po_I2. Additionally or alternatively the separate factors are deposited depending on the angle signal w, which indicates the angle location of leastwise one fuel post-injection Po_I1, Po_I2 in relation to the position of the crankshaft.

The individual factors of the engine map 36 of the correction value ti_Korr, m_Korr are preferably studied and stored only in preset operating statuses of the combustion engine 10 and/or the exhaust gas treating device 16. For determining the preset operating statuses, the operating status-determination 30 is designated, which provides the learn-enabling signal S_Lern, which closes the switch 31. The switch 31 symbolizes an enabling for the listing of the individual factors in the engine map 36.

The operating status-determination 30 delivers the learn-enabling signal S_Lern for example depending on the fuel signal m_K. For instance it is checked, whether the fuel signal m_K and/or a change of the fuel signal m_K lies at least within one marginal value. A lower and/or an upper boundary can be stipulated for example. Furthermore for example the regeneration signal Reg is preferably considered, which indicates that the exhaust gas treating device 16 is being regenerated at this moment. Preferably the learn-enabling signal S_Lern is suppressed in the presence of the regeneration signal Reg. Furthermore the learn-enabling signal S_Lern can be released depending on the temperature signal T. The temperature signal T can be for example the temperature of the combustion engine 10 and/or the temperature of the exhaust zone 13 and/or the temperature of the lambda sensor 15.

Furthermore the operating status determination 30 can provide the learn-enabling signal S_Lern depending on the driving speed v of a not further displayed motor vehicle, that is powered by the combustion engine 10. It can be observed for instance, whether the driving speed equals zero, so that an idling of the combustion engine 10 can be assumed.

Furthermore the pressure signal p can be considered, whereby the first and/or second pressure p1, p2 of the reagent for instance is meant. Alternatively or additionally the speed engine signal n can be considered. Particularly the fuel signal m_K and/or the pressure signal p and/or the engine speed signal n can provide a dimension for the deviation of the of the combustion engine 10, depending on which the learn-enabling signal S_Lern is displayed.

The correction value ti_Korr, m_Korr is preferably added in the adder 37 to the dimension m_Soll for the nominal value of the reagent. Compared to a multiplicative connection, the addition shows the significant advantage, that the mistake is significantly lower in a faulty correction value ti_Korr, m_Korr, than it would be in a multiplicative connection.

The reagent signal S_Rea can directly be a dimension for the amount of the reagent. The reagent signal S_Rea is preferably already a control value, which is suitable for controlling the reagent introduction device 14 and/or the exhaust gas metering device 26. In that case the reagent signal S_Rea is preferably a time duration, which mirrors for example the opening time of a valve. In this case before the adder 37 a conversion 38 is designated, which transforms the dimension m_Soll for the nominal value of the reagent from an amount into a time duration. Accordingly the corresponding dimension for an allocated time of a valve-opening is added to the correction value storage 35 instead of the dimension m_Soll for the nominal value. The connection is shown dash-lined in the FIGURE.

The invention claimed is:

1. A device for operating an internal combustion engine, the device comprising a controller configured to implement a method of operating the internal combustion engine having an exhaust zone that contains an exhaust gas treating device, wherein a pressurized oxidizable reagent is injected into the exhaust zone with the internal combustion engine or the exhaust gas treating device operating at a default status; the method including determining a correction value for a reagent signal which determines a quantity of the pressurized oxidizable reagent injected into the exhaust zone, wherein the correction value is determined by a comparison of a measure of an actual quantity of the pressurized oxidizable reagent in the exhaust zone, which has been introduced due to a measure of a preset target quantity of the pressurized oxidizable reagent, and a measure of a target quantity of the pressurized oxidizable reagent, and wherein the correction value is determined at a plurality of different pressure values when the internal combustion engine is operating in an idle status.

2. A device according to claim 1 wherein the customized controller comprises at least one correction value storage configured to store at least one correction value determined during a learning process.

3. A method of operating an internal combustion engine having an exhaust zone that contains an exhaust gas treating device, wherein a pressurized oxidizable reagent is injected into the exhaust zone with the internal combustion engine or the exhaust gas treating device operating at a default status, the method comprising:

determining a correction value for a reagent signal that determines a quantity of the pressurized oxidizable reagent injected into the exhaust zone, wherein the correction value is determined by a comparison of a measure of an actual quantity of the pressurized oxidizable reagent in the exhaust zone, which has been introduced due to a measure of a preset target quantity of the pressurized oxidizable reagent, and a measure of a target quantity of the pressurized oxidizable reagent, wherein the correction value is determined at a plurality of different pressure values when the internal combustion engine is operating in an idle status; and injecting the pressurized oxidizable reagent directly into the exhaust zone.

4. A method according to claim 3, further comprising determining the measure of the actual quantity of the pressurized oxidizable reagent by a lambda signal, wherein the actual quantity of the pressurized oxidizable reagent is measured in the exhaust zone.

5. A method according to claim 4, further comprising acquiring an air signal in a suction zone of the internal combustion engine, wherein the air signal is used for determining the measure of the actual quantity of the pressurized oxidizable reagent in addition to the lambda signal.

6. A method according to claim 3, further comprising determining the measure of the actual quantity of the pressurized oxidizable reagent by an occurring calculated air lambda in the exhaust zone.

7. A method according to claim 3, further comprising determining the measure of the actual quantity of the pressurized oxidizable reagent by a lambda signal, wherein the actual quantity of the pressurized oxidizable reagent is measured in the exhaust zone, wherein an expected lambda change is calculated and used for correction of the lambda signal.

8. A method according to claim 3, further comprising determining the correction value within a scope of a learn procedure, wherein the learn procedure is operated with the internal combustion engine or the exhaust gas treating device operating at a preset status.

9. A method according to claim 3, further comprising determining the correction value wherein a fuel amount or a change in fuel amount introduced into the internal combustion engine operating at a specific status is within at least one marginal value.

10. A method according to claim 3, further comprising introducing a fuel into the internal combustion engine, wherein the correction value is determined at different amounts of the fuel brought into the internal combustion engine.

11. A method according to claim 3, wherein the correction value is added to the measure of the target quantity of the pressurized oxidizable reagent.

12. A method according to claim 3, wherein at least a single fuel-post injection is utilized to inject the pressurized oxidizable reagent into the exhaust zone, wherein the pressurized oxidizable reagent is a fuel.

13. A method according to claim 12, further comprising determining the correction value is for at least a single fuel-post injection, or a plurality of fuel-post injections wherein the plurality of fuel-post injections are designated.

* * * * *